US010197302B2

(12) United States Patent
Suzuki et al.

(10) Patent No.: US 10,197,302 B2
(45) Date of Patent: Feb. 5, 2019

(54) LOCAL AIR CLEANING APPARATUS

(75) Inventors: Taketo Suzuki, Tokyo (JP); Tomoyuki Kakinuma, Tokyo (JP); Kozo Nitta, Tokyo (JP); Yuki Fujishiro, Tokyo (JP); Kazuma Fukiura, Tokyo (JP); Takahiro Sato, Tokyo (JP)

(73) Assignee: Koken Ltd., Tokyo (JP)

( * ) Notice: Subject to any disclaimer, the term of this patent is extended or adjusted under 35 U.S.C. 154(b) by 574 days.

(21) Appl. No.: 14/234,737

(22) PCT Filed: Jun. 22, 2012

(86) PCT No.: PCT/JP2012/066032

§ 371 (c)(1),
(2), (4) Date: Aug. 18, 2014

(87) PCT Pub. No.: WO2013/018461

PCT Pub. Date: Feb. 7, 2013

(65) Prior Publication Data

US 2015/0059298 A1 Mar. 5, 2015

(30) Foreign Application Priority Data

Jul. 29, 2011 (JP) ..... 2011-166316
Sep. 9, 2011 (JP) ..... 2011-196726
Oct. 7, 2011 (JP) ..... 2011-222785

(51) Int. Cl.
*F24F 3/16* (2006.01)
*F24F 13/068* (2006.01)

(52) U.S. Cl.
CPC ..... *F24F 13/068* (2013.01); *F24F 3/1607* (2013.01)

(58) Field of Classification Search
CPC . B01D 46/13; F24F 7/06; F24F 3/1607; F24F 2013/608; F24F 3/16; F24F 13/06; F24F 2011/04

(Continued)

(56) References Cited

U.S. PATENT DOCUMENTS 3,998,142 A 12/1976 Foreman et al.
4,023,472 A 5/1977 Grunder et al.

(Continued)

FOREIGN PATENT DOCUMENTS

JP 55-118754 9/1980
JP 57-28225 2/1982

(Continued)

OTHER PUBLICATIONS

Canadian Second Examiner's Report dated Jan. 14, 2016, in Canadian App. No. 2,841,243.

(Continued)

*Primary Examiner* — Duane Smith
*Assistant Examiner* — Minh Chau T Pham
(74) *Attorney, Agent, or Firm* — Greer Burns & Crain Ltd.

(57) ABSTRACT

A local air cleaning apparatus (1) is provided with a push hood (2) having an air flow opening face (23) for blowing out a cleaned uniform air flow and a guide (3) provided on a side of the push hood (2) having the air flow opening face (23), the guide (3) extending from the side thereof having the air flow opening face (23) toward a downstream side of the uniform air flow to form an opening face (31) at a downstream end portion thereof. The push hood (2) is arranged such that the uniform air flow blown out from the air flow opening face (23) passes through the inside of the guide (3) and then collides with an air collision face (W) on a downstream side of the opening face (31). The opening face (31) of the guide (3) is spaced apart from and opposed to the air collision face (W) to form an open region between the opening face (3) and the air collision face (W). The cleaned uniform air flow blown out from the air flow opening face (23) collides with the air collision face (W) and flows out of the opening region, thereby allowing the inside (Continued)

of the guide (3) and the inside of the open region to have higher cleanliness than other regions.

22 Claims, 10 Drawing Sheets

(58) Field of Classification Search
USPC ..... 55/385.2; 454/187
See application file for complete search history.

(56) References Cited

U.S. PATENT DOCUMENTS

| | | | | |
|---|---|---|---|---|
| 4,927,438 | A | 5/1990 | Mears et al. | |
| 5,326,316 | A | 7/1994 | Hashimoto et al. | |
| 5,487,768 | A | 1/1996 | Zytka et al. | |
| 6,113,486 | A | 9/2000 | Beudon et al. | |
| 6,632,260 | B1 * | 10/2003 | Siemers ..... | B01D 46/0013 454/184 |
| 9,410,710 | B2 | 8/2016 | Suzuki et al. | |
| 2004/0198215 | A1 * | 10/2004 | Bridenne ..... | F24F 3/1607 454/187 |
| 2008/0057851 | A1 * | 3/2008 | Valkeapaa ..... | F24F 9/00 454/191 |
| 2012/0297741 | A1 | 11/2012 | Reid et al. | |
| 2014/0366498 | A1 | 12/2014 | Suzuki et al. | |
| 2015/0059298 | A1 | 3/2015 | Suzuki et al. | |

FOREIGN PATENT DOCUMENTS

| | | | |
|---|---|---|---|
| JP | 61-027435 | | 2/1986 |
| JP | 63-176943 | | 7/1988 |
| JP | 64-034420 | | 2/1989 |
| JP | 03-080951 | | 4/1991 |
| JP | 6-178907 | | 6/1994 |
| JP | 09-057033 | | 3/1997 |
| JP | 11-218355 | | 8/1999 |
| JP | 2003-31451 | | 1/2003 |
| JP | 2004-012038 | | 1/2004 |
| JP | 2004-525337 | | 8/2004 |
| JP | 2006-242419 | | 9/2006 |
| JP | 2006-242419 | A | 9/2006 |
| JP | 2008-275266 | | 11/2008 |
| JP | 2008275266 | A * | 11/2008 |
| WO | WO 98/50134 | | 11/1998 |
| WO | WO 2005/113169 | A1 | 12/2005 |
| WO | WO 2011/085735 | A1 | 7/2011 |

OTHER PUBLICATIONS

U.S. Appl. No. 14/347,330, filed Mar. 26, 2014.
U.S. Appl. No. 14/131,599, filed Jan. 8, 2014.
EESR for App. No. 12820022.7 (counterpart of U.S. Appl. No. 14/234,737) dated Feb. 23, 2015.
EESR for App. No. 12837874.2 (counterpart application of U.S. Appl. No. 14/347,330) dated Oct. 4, 2015.
Australian Office Action for App. No. 2012281804 (counterpart application of U.S. Appl. No. 14/131,599) dated Mar. 5, 2015.
Australian Examination Report dated Mar. 27, 2015 in App. No. 2012319869.
Canadian First Examiner's Report dated Apr. 2, 2015, in App. No. 2,850,285.
Korean Office Action dated Apr. 22, 2015 in App. No. 10-2014-7007201.
Extended European Search Report dated Feb. 23, 2015 in App. No. 12 820 022.7.
Australian Examination Report No. 1 dated Mar. 5, 2015, in App. No. 2012291379.
Canadian First Examiner's Report dated Mar. 26, 2015, in App. No. 2,842,895.
Korean Office Action dated Apr. 20, 2015, in App. No. 10-2014-7001854.
Int'l. Search Report issued in Int'l. App. No. PCT/JP2012/066032, dated Aug. 28, 2012 (with translation).
Int'l. Search Report issued in Int'l. App. No. PCT/JP2012/066033, dated Sep. 4, 2012.
Translation of Informal Comment submitted to WIPO dated Feb. 20, 2013.
Int'l. Search Report issued in Int'l App. No. PCT/JP2012/066031, dated Aug. 28, 2012 (with translation).
Extended European Search Report dated Feb. 23, 2015 in App. No. 12 811 470.9.
Australian Examination Report No. 1 dated Mar. 6, 2015, in App. No. 2012281804.
Canadian First Examiner's Report dated Mar. 26, 2015, in App. No. 2,841,243.
Korean Office Action dated Apr. 16, 2015, in App. No. 10-2014-7000442.
U.S. Appl. No. 14/131,599, filed Aug. 18, 2014.

* cited by examiner

| | FLOW RATE (m/s) | GUIDE LENGTH b(m) | DISTANCE X(m) |
|---|---|---|---|
| EXAMPLE 2 | 0. 5 | 12. 0 | 13. 0 |
| EXAMPLE 3 | 0. 5 | 12. 0 | 13. 5 |
| EXAMPLE 4 | 0. 5 | 18. 5 | 20. 0 |
| EXAMPLE 5 | 0. 3 | 14. 0 | 15. 0 |
| EXAMPLE 6 | 0. 3 | 19. 0 | 20. 0 |
| EXAMPLE 7 | 0. 2 | 12. 0 | 12. 8 |
| EXAMPLE 8 | 0. 2 | 12. 0 | 13. 0 |
| EXAMPLE 9 | 0. 2 | 19. 2 | 20. 0 |
| EXAMPLE 10 | 0. 2 | 14. 0 | 15. 0 |

FIG. 15

| | NUMBER OF PIECES INSTALLED | FLOW RATE (m／s) | GUIDE LENGTH b(m) | DISTANCE X−b(m) | JUDGMENT |
|---|---|---|---|---|---|
| EXAMPLE 11 | 3×3 (9PIECES) | 0. 5 | 12. 0 | 1. 5 | ○ |
| REFERENCE EXAMPLE 1 | | | | 1. 7 | × |
| EXAMPLE 12 | | 0. 3 | | 1. 1 | ○ |
| REFERENCE EXAMPLE 2 | | | | 1. 3 | × |
| EXAMPLE 13 | | 0. 2 | | 0. 8 | ○ |
| REFERENCE EXAMPLE 3 | | | | 1. 0 | △ |
| EXAMPLE 14 | 1×1 (1PIECE) | 0. 5 | 12. 0 | 0. 7 | ○ |
| REFERENCE EXAMPLE 4 | | | | 0. 8 | × |
| EXAMPLE 15 | | 0. 3 | | 0. 6 | ○ |
| REFERENCE EXAMPLE 5 | | | | 0. 7 | × |
| EXAMPLE 16 | | 0. 2 | | 0. 4 | ○ |
| REFERENCE EXAMPLE 6 | | | | 0. 5 | × |
| EXAMPLE 17 | 2×2 (4PIECES) | 0. 5 | 12. 0 | 1. 2 | ○ |
| REFERENCE EXAMPLE 7 | | | | 1. 3 | × |
| EXAMPLE 18 | | 0. 3 | | 0. 9 | ○ |
| REFERENCE EXAMPLE 8 | | | | 1. 0 | × |
| EXAMPLE 19 | | 0. 2 | | 0. 6 | ○ |
| REFERENCE EXAMPLE 9 | | | | 0. 7 | × |

| | FLOW RATE (m/s) | GUIDE LENGTH b(m) | DISTANCE X−b(m) | c(m) | d(m) |
|---|---|---|---|---|---|
| EXAMPLE 20 | 0. 5 | 12. 0 | 2. 0 | 1. 93 | 0. 52 |
| REFERENCE EXAMPLE 10 | | | 2. 1 | 2. 03 | 0. 54 |
| EXAMPLE 21 | 0. 2 | | 1. 2 | 1. 16 | 0. 30 |
| REFERENCE EXAMPLE 11 | | | 1. 3 | 1. 26 | 0. 32 |

LOCAL AIR CLEANING APPARATUS

TECHNICAL FIELD

The present invention relates to a local air cleaning apparatus.

BACKGROUND ART

Conventionally, a clean bench is often used as an apparatus for improving air cleanliness of a local work space. In a typical clean bench, only a front side of the work bench has an opening for performing work and sides thereof other than the front side form an enclosure in order to maintain cleanliness. In such a clean bench, a clean air outlet is arranged in the enclosure, and a worker puts his or her hands therein from the front opening for working to perform work.

However, the opening for working in the clean bench is narrow. Accordingly, for workers performing the assembly of precision instrument or the like, there is a problem with workability. In addition, as in a production line, when work involves the transfer of manufactured articles or manufacturing components, procedures such as arrangement of the entire line in the clean room have been taken. This is, however, problematic in terms of increasing the size of equipment.

Therefore, a local air cleaning apparatus has been proposed in which air flow opening faces of a pair of push hoods capable of blowing out a uniform flow of cleaned air are arranged opposite to each other to cause collision of air flows from the respective air flow opening faces so as to allow a region between a pair of push hoods to be a clean air space having higher cleanliness than other regions (Patent Literature 1).

CITATION LIST

Patent Literature

Patent Literature 1: Unexamined Japanese Patent Application Kokai Publication No. 2008-275266

SUMMARY OF INVENTION

Technical Problems

Meanwhile, depending on the kind of work and the procedures of work, it may be desirable in some cases to work in a little larger clean air space. In addition, it may be occasionally desirable to work using a local air cleaning apparatus having a little simpler structure. Therefore, there has been a desire for a local air cleaning apparatus having a simpler structure.

The present invention has been accomplished in view of the above problems, and it is an objective of the present invention to provide a local air cleaning apparatus having a simple structure.

Solution to Problems

In order to achieve the above objective, a local air cleaning apparatus of the present invention comprises:

a push hood comprising an air flow opening face for blowing out a cleaned uniform air flow and a guide provided on a side of the push hood comprising the air flow opening face, the guide extending from the side thereof comprising the air flow opening face toward a downstream side of the uniform air flow to form an opening face at an downstream-side end portion of the guide, wherein the push hood is arranged such that the cleaned uniform air flow blown out from the air flow opening face passes through the inside of the guide and then collides with an air collision face on a downstream side of the opening face of the guide;

the opening face of the guide is spaced apart from and opposed to the air collision face to form an open region between the opening face of the guide and the air collision face; and the cleaned uniform air flow blown out from the air flow opening face collides with the air collision face to flow out of the open region so as to cause the inside of the guide and the inside of the open region to have higher cleanliness than other regions.

Preferably, the opening face of the guide and the air flow opening face of the push hood are of substantially the same shape.

The push hood comprises, for example, a plurality of push hoods connected together.

Preferably, the cleaned uniform air flow blown out from the air flow opening face has a flow rate of 0.2 to 0.5 m/s.

The opening face of the guide has a width of, for example, 2 m or more and less than 10 m. In this case, preferably, the distance between the opening face of the guide and the air collision face is a distance over which the uniform air flow blown out from the opening face collides with the air collision face within 4 seconds.

The opening face of the guide has a width of, for example, 1 m or more and less than 2 m. In this case, preferably, the distance between the opening face of the guide and the air collision face is a distance over which the uniform air flow blown out from the opening face collides with the air collision face within 3 seconds.

The opening face of the guide has a width of, for example, 0.2 m or more and less than 1 m. In this case, preferably, the distance between the opening face of the guide and the air collision face is a distance over which the uniform air flow blown out from the opening face collides with the air collision face within 2 seconds.

Preferably, the air collision face has a bent portion bent toward the guide side near positions opposing end portions of the opening face of the guide.

In such a local air cleaning apparatus, the opening face of the guide has a width of, for example, 2 m or more and less than 10 m, and, preferably, the distance between the opening face of the guide and the air collision face is a distance over which the uniform air flow blown out from the opening face collides with the air collision face within 6 seconds.

In addition, the opening face of the guide has a width of, for example, 1 m or more and less than 2 m, and, preferably, the distance between the opening face of the guide and the air collision face is a distance over which the uniform air flow blown out from the opening face collides with the air collision face within 5 seconds.

Furthermore, the opening face of the guide has a width of, for example, 0.2 m or more and less than 1 m, and, preferably, the distance between the opening face of the guide and the air collision face is a distance over which the uniform air flow blown out from the opening face collides with the air collision face within 3 seconds.

Advantageous Effects of Invention

The present invention can provide a local air cleaning apparatus having a simple structure.

BRIEF DESCRIPTION OF DRAWINGS

FIG. 15 is a view depicting conditions for Examples 11 to 19 and Reference Examples 1 to 9;

DESCRIPTION OF EMBODIMENTS

Figure 1:
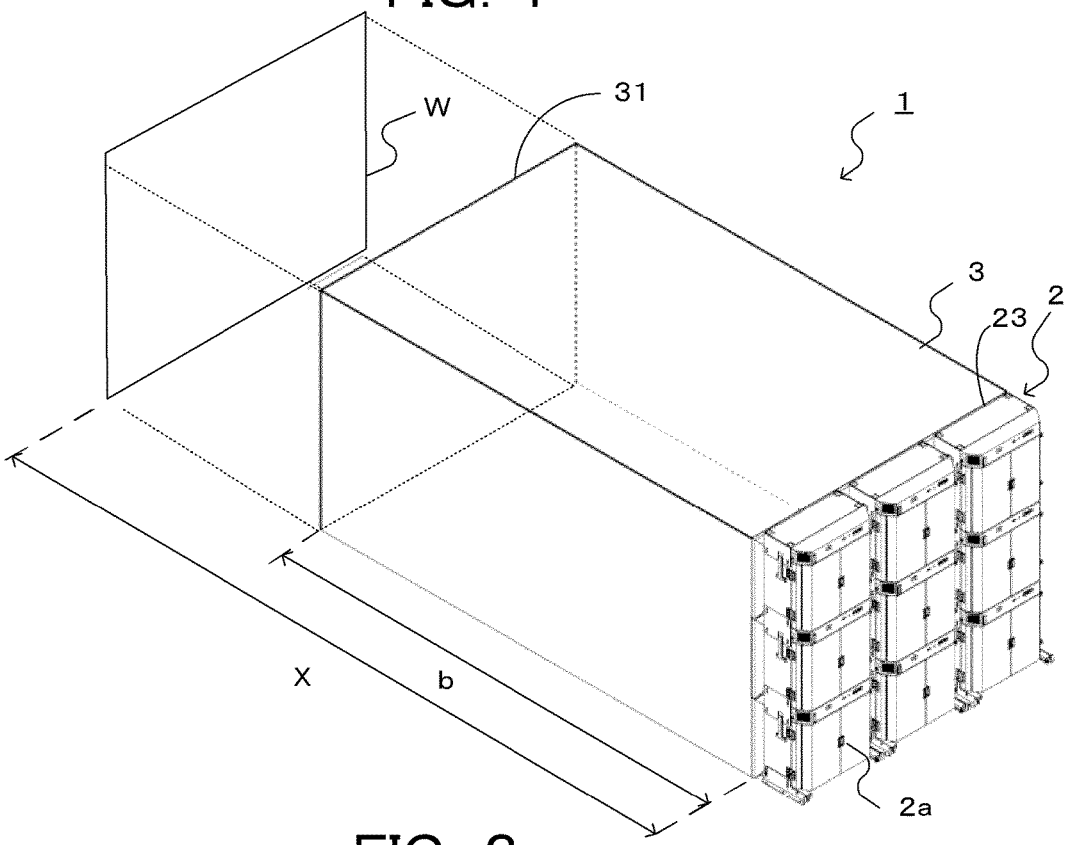
FIG. 1 is a view depicting a local air cleaning apparatus according to an embodiment of the present invention.

Hereinafter, a local air cleaning apparatus according to the present invention will be described with reference to the drawings. FIG. 1 is a view depicting an example of a local air cleaning apparatus according to an embodiment of the present invention.

As depicted in FIG. 1, a local air cleaning apparatus 1 of the present invention comprises a push hood 2 arranged so as to be opposed to an air collision face W such as a wall or a partition screen and a guide 3 provided on the push hood 2.

The push hood 2 can be any push hood as long as the push hood has a mechanism for blowing out a cleaned uniform air flow. As a structure of the push hood, there can be employed a structure in which a cleaning filter is incorporated in a basic structure of a push hood conventionally used in push-pull ventilators.

The terms uniform air flow and uniform flow used herein have the same meaning as uniform flow described in "Industrial Ventilation" by Taro Hayashi (published by the Society of Heating, Air-Conditioning and Sanitary Engineers of Japan, 1982) and refer to a flow having a minute air flow rate, which is uniformly continuous and causes no large whirling portion. However, the present invention does not intend to provide an air blowout apparatus strictly specifying an air flow rate and a velocity distribution. In the uniform air flow, for example, a variation in a velocity distribution in a state without obstacles is preferably within ±50%, and furthermore within ±30%, with respect to the average value.

Figure 2:
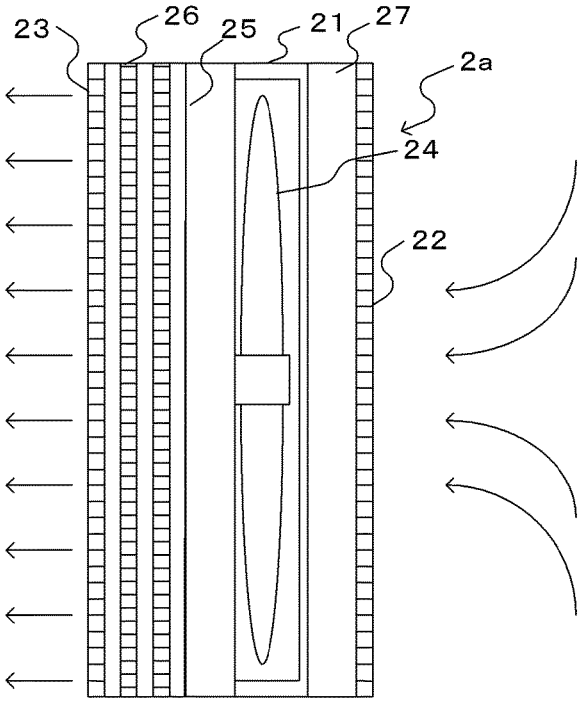
FIG. 2 is a view depicting the structure of a push hood.

In the push hood 2 of the present embodiment, respective nine (longitudinal three pieces×transversal three pieces) push hoods are connected by a connector in such a manner that the air flow opening faces of the push hoods are oriented in the same direction and short sides and long sides, respectively, of the push hoods are arranged adjacent to each other. Herein, structures of the push hoods connected by the connector are basically the same. Accordingly, a description will be given of the structure of a push hood 2*a* as one of the push hoods, thereby describing the structure of the push hood 2 of the present embodiment. FIG. 2 depicts the structure of the push hood 2*a*.

As depicted in FIG. 2, a housing 21 of the push hood 2*a* is formed into a substantially rectangular parallelepiped shape, and an air flow suction face 22 is formed on one surface of the housing 21. The air flow suction face 22 comprises, for example, a face having a plurality of holes formed entirely on the one surface of the housing 21. Through the holes, the air flow suction face 22 takes in an outside air or a room air, which is a surrounding air outside the push hood 2*a*. In addition, on the other surface of the housing 21 opposing the air flow suction face 22 is formed an air blowout face (an air flow opening face) 23. The air flow opening face 23 comprises, for example, a face with a plurality of holes formed entirely on the one surface of the housing 21. Through the holes, the air flow opening face 23 blows out the uniform air flow of a cleaned air formed in the push hood 2*a* to the outside of the push hood 2*a*. The dimensions of the air flow opening face 23 of the push hood 2*a* are not particularly limited, for example, 1050×850 mm.

Figure 3:
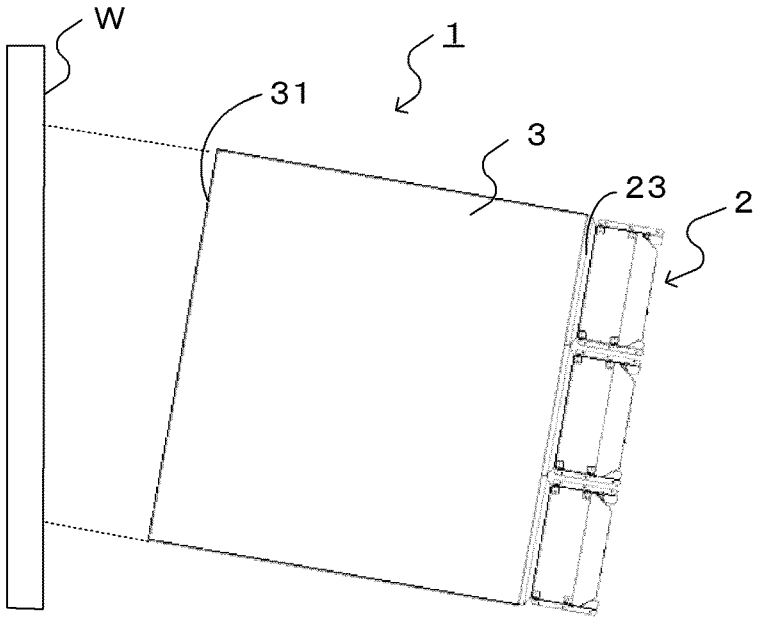
FIG. 3 is a view depicting another example of the local air cleaning apparatus.

The push hood 2 is arranged such that the air flow opening face thereof is opposed to an air collision face W such as a wall. Herein, the description "the air flow opening face is opposed to the air collision face W" means not only a state in which the air flow opening face 23 of the push food 2 and the air collision face W are opposed in parallel to each other, but also, for example, a state in which the air flow opening face 23 of the push food 2 and the air collision face W are slightly inclined from each other, as depicted in FIG. 3. Regarding the inclination between the air flow opening face 23 of the push hood 2 and the air collision face W, an angle formed by the air flow opening face 23 and the air collision face W is preferably in a range of about 30 degrees.

In the housing 21 are arranged an air blowing mechanism 24, a high performance filter 25, and a rectification mechanism 26.

The air blowing mechanism 24 is arranged on a side where the air flow suction face 22 is located in the housing 21. The air blowing mechanism 24 comprises an air blowout fan and the like. The air blowing mechanism 24 takes in an outside air or a room air, which is the surrounding air of the push hood 2*a*, from the air flow suction face 22 and blows out an air flow from the air flow opening face 23. In addition, the air blowing mechanism 24 is configured to control a blowout force of the fan so as to allow the flow rate of an air flow blown out from the air flow opening face 23 to be changed.

The high performance filter 25 is arranged between the air blowing mechanism 24 and the rectification mechanism 26. The high performance filter 24 comprises a high performance filter in accordance with a cleaning level, such as a HEPA filter (High Efficiency Particulate Air Filter) or an ULPA filter (Ultra Low Penetration Air Filter) for filtrating the surrounding air taken in. The high performance filter 25 cleans the surrounding air taken in by the air blowing mechanism 24 into a clean air having a desirable cleaning level. The clean air cleaned to the desirable cleaning level by the high performance filter 25 is sent to the rectification mechanism 26 by the air blowing mechanism 24.

The rectification mechanism 26 is arranged between the high performance filter 25 and the air flow opening face 23. The rectification mechanism 26 is provided with a not-shown air resistor, which is formed using a punching plate, a mesh member, and/or the like. The rectification mechanism 26 corrects (rectifies) a blown air sent from the higher performance filter and having an amount of aeration biased with respect to the entire part of the air flow opening face 23 into a uniformized air flow (a uniform air flow) having an amount of aeration unbiased with respect to the entire part of the air flow opening face 23. The uniform air flow rectified is blown out by the air blowing mechanism 24 from the entire part of the air flow opening face 23 to the outside of the push hood 2.

In addition, as depicted in FIG. 2, the push hood 2*a* is preferably provided with a pre-filter 27 between the air flow suction face 22 and the air blowing mechanism 24 in the housing 21. An example of the pre-filter 27 may be a medium performance filter. The arrangement of the pre-filter 27 between the air flow suction face 22 and the air blowing mechanism 24 allows removal of relatively large dust particles contained in a surrounding air sucked into the housing 21 through the air flow suction face 22. In this manner, dust particles can be removed in multiple stages in accordance with the size of dust particles contained in the surrounding air. Accordingly, the performance of the high performance filter 25 easily causing clogging or the like can be maintained for a long period.

In the push hood 2*a* thus formed, the surrounding air taken in by the air blowing mechanism 24 is cleaned into a clean air having a desirable cleaning level by the pre-filter 27 and the high performance filter 25. Then, the clean air obtained by the cleaning is rectified into a uniform air flow by the rectification mechanism 26. The uniform air flow thus cleaned is blown out externally from the entire part of the air flow opening face 23 in a direction substantially vertical to the air flow opening face 23 of the push hood 2*a*.

One end of the guide 3 is provided on the side of the push hood 2 having the air flow opening face 23. In addition, the guide 3 is provided on the air flow opening face 23 and formed in such a manner as to extend therefrom toward the downstream side of the uniform air flow blown out from the air flow opening face 23 and cover an outer peripheral outline portion of the air flow opening face 23. For example, when the air flow opening face 23 is rectangular, the guide 3 is formed to be extended so as to have a U-shaped. With an open side of the U-shaped and a floor, the guide 3 including the outer peripheral outline portion in a blowout direction of the uniform air flow surrounds, like a tunnel, the periphery of an air flow in parallel to a stream of the uniform air flow blown out from the air flow opening face 23. Additionally, when there is no floor, the guide 3 is formed to be extended so as to have, for example, a square cross-sectional shape, not a U-shaped. The guide 3 is formed so as to have an open region between the other end thereof (the opening face 31) and. Herein, the opening face 31 of the guide 3 refers to a hollow end face, namely an opening, which is surrounded by the peripheral edge outline of a downstream-side end portion (a boundary with the open region) of the guide 3 extending like the tunnel toward the downstream side of the uniform air flow blown out from the air flow opening face 23. For example, in a case of substituting the floor for a part of the guide 3, when the cross section of the guide 3 is U-shaped, a square hollow opening formed by the downstream-side end portion of the guide 3 and the floor corresponds to the opening face 31. When the cross section of the guide 3 is square, a square hollow opening formed at the downstream-side end portion of the guide 3 corresponds to the opening face 3.

The guide 3 can be formed using an arbitrary material as long as an air flow blown out from the opening face 31 can maintain the state of a cleaned uniform air flow blown out from the air flow opening face 23. In addition, the guide 3 does not necessarily have to completely cover the entire periphery of the uniform air flow as long as the state of the cleaned uniform air flow blown out from the air flow opening face 23 can be maintained. For example, a hole may be opened or a slit may be formed in a part of the guide 3.

Figure 4:
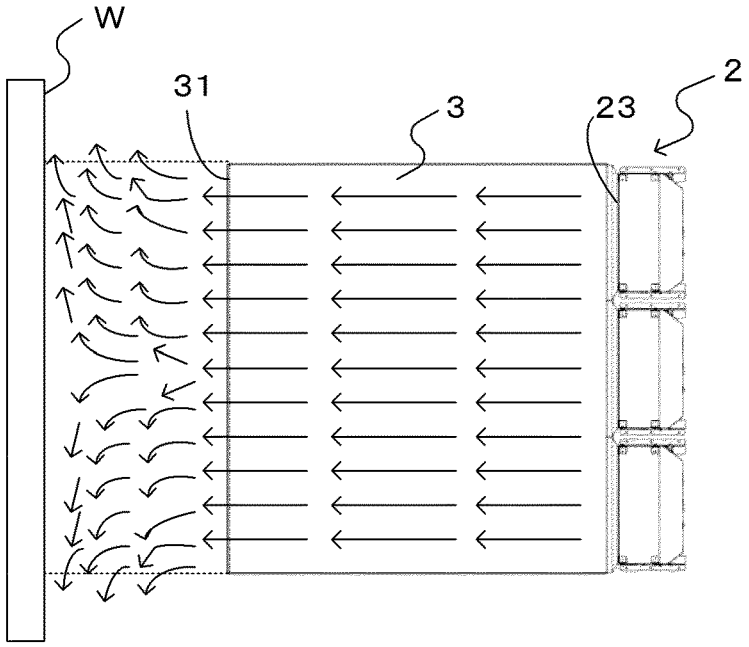
FIG. 4 is a view illustrating the stream of a cleaned uniform air flow.

The guide 3 is arranged such that the opening face 31 thereof is opposed to the air collision face W. By arranging the guide 3 such that the opening face 31 is opposed to the air collision face W, an air flow blown out from the opening face 31 collides with the air collision face W. As depicted in FIG. 4, when the opening face 31 is opposed in parallel to a wall, the uniform air flow collides with the air collision face W and then exhibits a behavior of changing the direction of the flow substantially vertically. By flowing in such a manner, the air flow, after having collided with the air collision face W, flows outside the face with which the air flow collided. As a result, a clean space can be obtained in a region from the collision face of the air flow to the end portion of the opening face 31.

Herein, the description "the opening face 31 is opposed to the air collision face W" means not only a state in which the opening face 3 is opposed in parallel to the air collision face W, but also, for example, a state in which the opening face 31 of the guide 3 and the air collision face are slightly inclined from each other, as depicted in FIG. 3. This is because even in the state in which the air flow blown out from the opening face 31 does not collide head on with the air collision face W, a clean space can be formed in a space surrounded by a dotted line in FIG. 3. An angle formed by the opening face 31 of the guide 3 and the air collision face W is preferably in a range of about 30 degrees.

Figure 5:
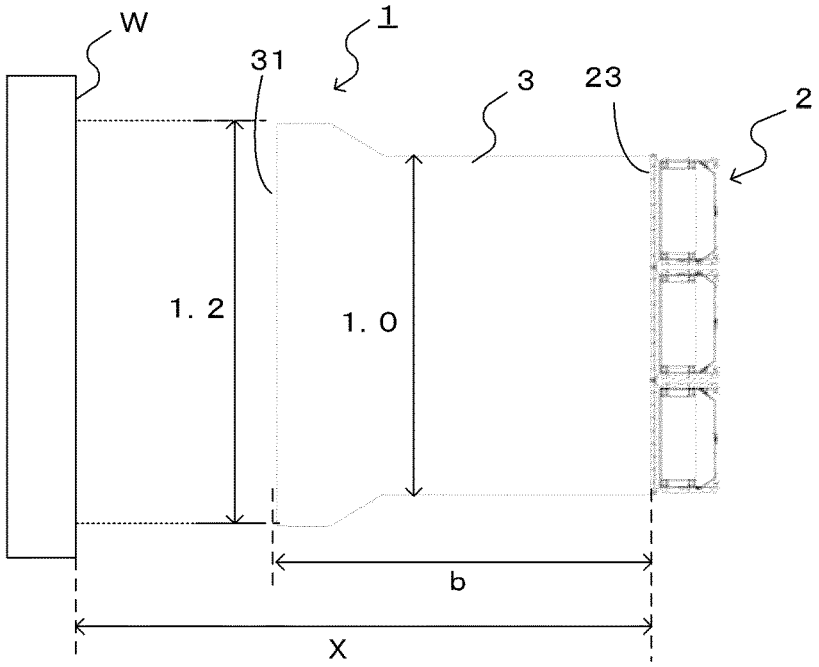
FIG. 5 is a view depicting another example of the local air cleaning apparatus.
Figure 6:
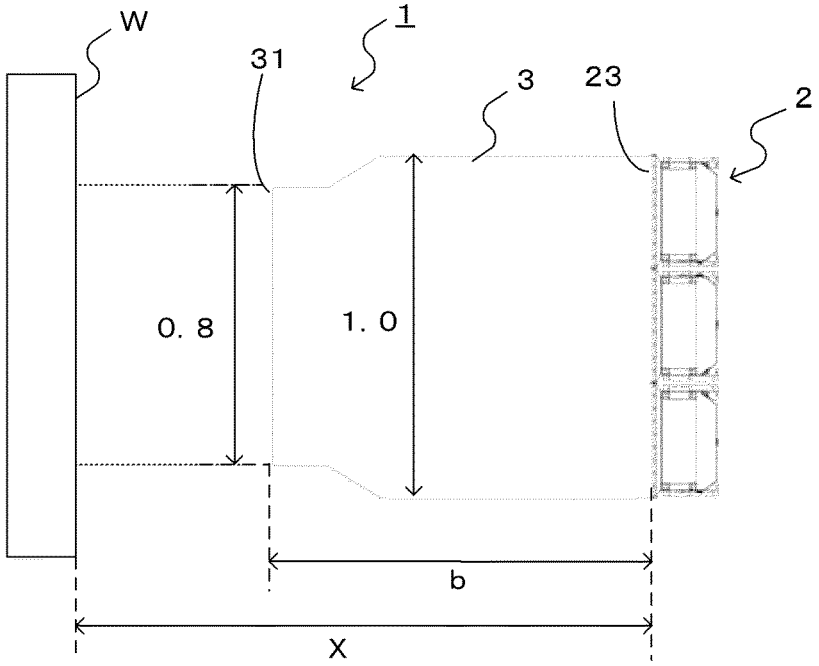
FIG. 6 is a view depicting another example of the local air cleaning apparatus.

Preferably, the opening face 31 is formed so as to have substantially the same shape as the air flow opening face 23. This is because when the opening face 31 and the air flow opening face 23 are formed to have substantially the same shape, the state of a uniform air flow blown out from the air flow opening face 23 can be easily maintained in the opening face 31. However, the shapes of the opening face 31 and the air flow opening face 23 do not necessarily have to be substantially the same. For example, as depicted in FIGS. 5 and 6, the width of the opening face 31 may be increased or reduced to differentiate the shapes of the opening face 31 and the air flow opening face 23 from each other, because even in this case, the state of the uniform air flow can be maintained. In the increase or reduction of the width of the opening face 31, (width of opening face 31)/(width of air flow opening face 23) is preferably 0.6 to 1.4 and more preferably 0.8 to 1.2. By setting the width ratio in the above range, the state of the uniform air flow blown out from the air flow opening face 23 can be maintained in the opening face 31.

A length b of the guide 3 can be any length as long as an open region can be formed between the opening face 31 of the guide 3 and the air collision face W when the opening face 31 thereof and the air collision face W are spaced apart from and opposed to each other. Preferably, the length b of the guide 3 is set to a predetermined length according to a distance X between the air flow opening face 23 of the push hood 2 and the air collision face W, the flow rate of a uniform air flow blown out from the air flow opening face 23 (the opening face 31), and the like.

As will be described below, when the length b of the guide 3 is 12 m, a distance (X-b) between the opening face 31 of the guide 3 and the air collision face W is preferably set to be not more than a distance of 4 times a flow rate (a distance over which a uniform air flow blown out from the opening face 31 collides with the air collision face W within 4 seconds) when the width of the opening face 31 is 2 m or more and less than 10 m. In addition, when the width of the opening face 31 is 1 m or more and less than 2 m, the distance (X-b) therebetween is preferably set to be not more than a distance of 3 times a flow rate (a distance over which the uniform air flow blown out from the opening face 31 collides with the air collision face W within 3 seconds). Furthermore, when the width of the opening face 31 is 0.2 m or more and less than 1 m, the distance (X-b) therebetween is preferably set to be not more than a distance of 2 times a flow rate (a distance over which the uniform air flow blown out from the opening face 31 collides with the air collision face W within 2 seconds). This is because setting the distance (X-b) to the distances allows the inside of the guide 3 and the open region between the opening face 31 and the air collision face W to have high cleanliness.

Figure 7:
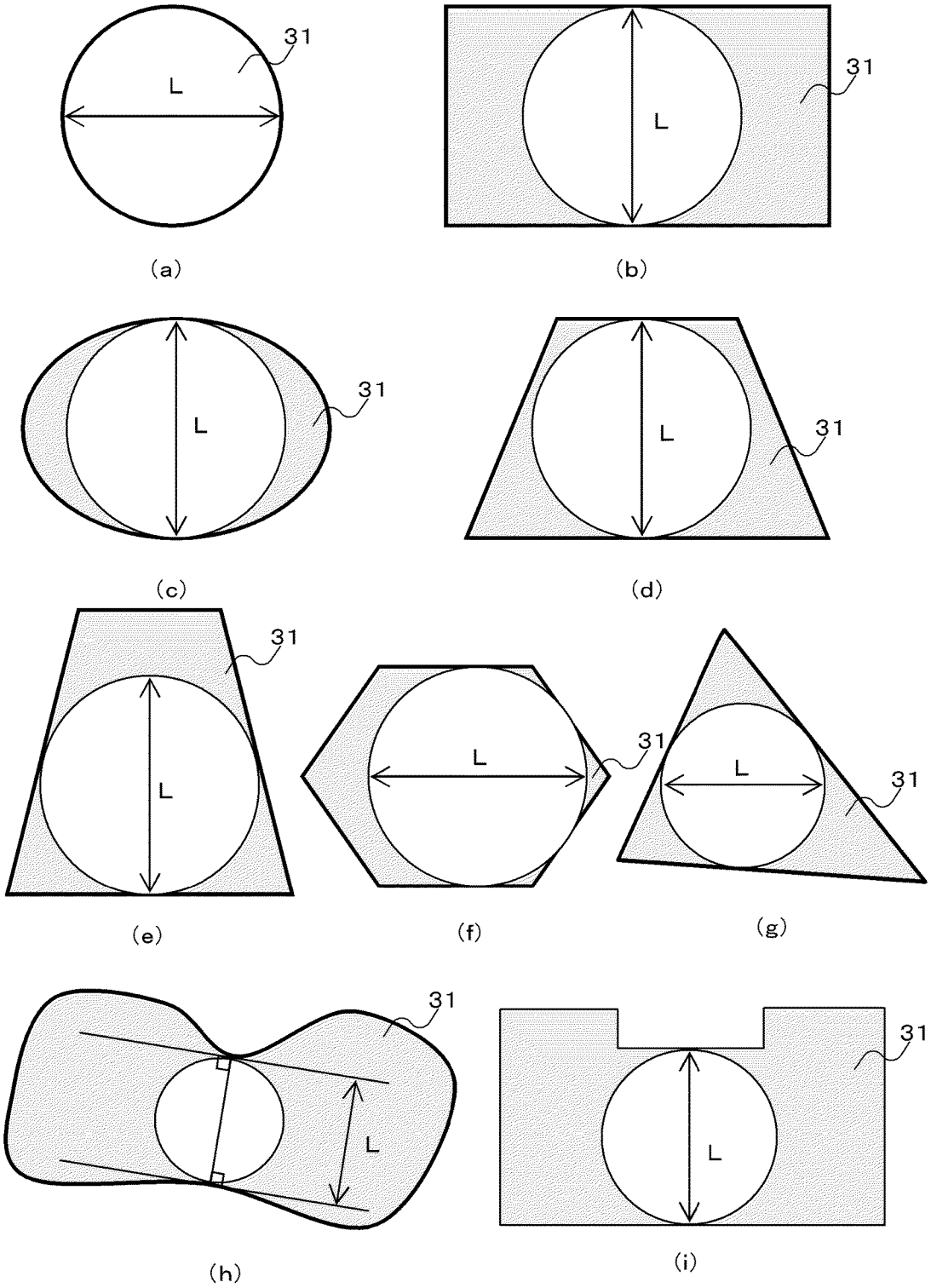
FIG. 7 are views illustrating the width of the opening face of the guide.

Herein, when the opening face 31 is a circle, a width (L) of the opening face 31 refers to the diameter of the circle, as depicted in FIG. 7A. In addition, when the opening face 31 is a rectangle, the width (L) of the opening face 31 refers to the diameter of a maximum circle inscribed in the rectangle, namely the length of a short side of the rectangle, as depicted in FIG. 7B. In addition, when the opening face 31 is an oval or a polygon, the width (L) of the opening face 31 refers to the diameter of a maximum circle inscribed in each of the figures, as depicted in FIGS. 7C to 7G. Furthermore, when the opening face 31 has a shape including concave portions, the width (L) of the opening face 31 refers to the diameter of a circle inscribed at a position where the distance between sides facing each other is shortest, as depicted in FIG. 7H. Still furthermore, when the opening face 31 has a shape with a concavity, the width (L) of the opening face 31 refers to the diameter of a circle inscribed at a position where the distance between a side having the concavity and a side facing the side is shortest, as depicted in FIG. 7I.

The guide 3 thus formed is, as depicted in FIG. 1, provided (attached) from the side of the push hood 2 having the air flow opening face 23 toward the downstream side of a uniform air flow and arranged such that the opening face 31 provided at the end portion of the downstream side is opposed to the air collision face W. In this manner, an open region is formed between the opening face 3 and the air collision face W.

In the local air cleaning apparatus 1 thus formed, a surrounding air near the air flow suction face 22 taken in by the air blowing mechanism 24 of the push hood 2 is cleaned by the pre-filter 27 and the high performance filter 25 into a clean air having a desirable cleaning level. Then, the clean air obtained by the cleaning is rectified into a uniform air flow by the rectification mechanism 26 and the cleaned uniform air flow is blown out into the guide 3 from the entire part of the air flow opening face 23.

Herein, the cleaned uniform air flow blown out from the air flow opening face 23 has a flow rate of preferably 0.3 to 0.5 m/s. In order to suppress power consumption, the air velocity can be reduced to 0.2 to 0.3 m/s. When the inside of the local air cleaning apparatus 1 is contaminated and quick cleaning is desirable, the air velocity can be reduced to 0.5 to 0.7 m/s. Accordingly, the flow rate of the cleaned uniform air flow can be selected as needed. This is because, by blown out at these flow rates, the cleaned uniform air flow blown out from the air flow opening face 23 moves through the inside of the guide 3 as if extruded and the state of the uniform air flow can be easily maintained in the guide 3. Additionally, slowing the flow rate can reduce the number of rotation of the fan of the air blowing mechanism, whereby noise level and power consumption can be suppressed. Due to the reduction, the volume of air blown is reduced, which can thus reduce the amount of dust accumulated on the pre-filter 27 and the high performance filter 25. On the other hand, in a situation in which contaminants are generated in a cleaned space of the guide 3, setting the flow rate of the uniform air flow to about 0.5 m/s allows the contaminants in the guide 3 and in the open region formed between the guide 3 and the air collision face W to be removed more quickly than at a flow rate of the uniform air flow of 0.2 m/s. Thus, the flow rate of the uniform air flow can be freely set according to the purpose of use. Meanwhile, an excessive increase in the air velocity of the uniform air flow blown out from the air flow opening face 23 leads to the occurrence of a whirling portion, and when the uniform air flow is blown out from the opening face 31, turbulence can occur and thereby contaminants outside the open region may be rolled up into the open region formed between the guide 3 and the air collision face W. Accordingly, preferably, the air velocity of the uniform air flow blown out from the air flow opening face 23 is set to an air velocity that does not cause any whirling portion.

The cleaned uniform air flow blown out to the guide 3 passes through the guide 3 while maintaining the state of the uniform air flow and then is blown out from the opening face 31. The air flow blown out from the opening face 31 collides with the air collision face W. The air flow, after having collided, flows outside the open region formed between the guide 3 and the air collision face W (outside the local air cleaning apparatus 1). As a result, the region between the air flow opening face 23 and the air collision face W (the inside of the guide 3 and the open region between the opening face 31 and the air collision face W) can have higher cleanliness than regions outside the local air cleaning apparatus 1.

Herein, a comparison was made between the present invention and the local air cleaning apparatus described in Patent Literature 1. For the comparison, dimensions of the air flow opening face of the push hood in both apparatuses were set to a width of 1050 mm and a height of 850 mm and nine push hoods ((longitudinal three pieces×transversal three pieces) each having the air flow opening face were connected together. In addition, the flow rate of a cleaned uniform air flow blown out from the air flow opening faces was set to 0.5 m/s. In this case, in the local air cleaning apparatus described in Patent Literature 1, it was confirmed that the upper limit of the distance between the air flow opening faces 23 obtained as a cleaned space was about 5.5 m. In contrast, in the local air cleaning apparatus 1 of the present invention, it was confirmed that the distance between the air flow opening face 23 and the air collision face W obtained as a cleaned space can be increased up to about 20 m. Thus, the local air cleaning apparatus 1 of the present invention can have a simple structure and can form a large clean air space.

In addition, compared to an open-type air cleaning apparatus using the technology described in Patent Literature 1, even when the flow rates of uniform air flows blown out from push hoods having the same area are the same, the present invention can provide a considerably larger clean air space. Furthermore, since the apparatus of the invention does not need a push food on both sides, even when the power consumption per push hood is the same, the amount of electricity consumed per unit area in the clean air space can be reduced. Or when cleaning the same clean space, air velocity can be slower than in Patent Literature 1, and therefore the number of rotation of the fan in the air blowing mechanism can be reduced, enabling the power consumption to be reduced. Then, since the air velocity can be slower, noise due to the operation of the local air cleaning apparatus can also be reduced. Additionally, since the volume of air passing through the filters is reduced, the amount of dust accumulated on the filters for obtaining a clean air is reduced, which can therefore suppress the exhaustion of the filters. Furthermore, when the open-type local air cleaning apparatus of Patent Literature 1 was installed under the above conditions, it was confirmed that power consumption was 7200 W and noise level was 75 dB(A) in the center between the air flow opening faces 23 opposed to each other. In contrast, in the apparatus of the present invention used under the above installation condition (the distance between the air flow opening face 23 and the air collision face W: 20 m), it was confirmed that power consumption was 3600 W and noise level was equivalent to that in Patent Literature 1 above in the center between the air flow opening face 23 and the air collision face W. In other words, in Patent Literature 1, a space having a volume of about 45 cubic meters was cleaned and the amount of electricity consumed for cleaning per cubic meter was about 160 W, whereas the apparatus of the present invention was confirmed to have cleaned a space having a volume of about 160 cubic meters and the amount of electricity consumed for cleaning per cubic meter was confirmed to be about 22.5 W. In addition, although the present invention described above has exemplified the case in which the distance between the air flow opening face 23 and the air collision face W is 20 m, increasing the distance can lead to further reduction in the power consumption per unit volume.

Furthermore, in a typical clean room, the entire room is cleaned and it is therefore not easy to perform construction work, whereas in the local air cleaning apparatus 1 of the present embodiment, the push hood 2 can be easily moved. In addition, the local air cleaning apparatus 1 of the embodiment can significantly facilitate layout changes in the work region, such as bending the guide 3 provided on the push hood 2 depending on the work in a range that does not affect the uniform air flow and moving an open region formed between the opening faces of the guides to an arbitrary position.

In addition, in the case of a typical clean room in which a worker himself or herself enters a clean region to perform work, a work region for the worker is not changed no matter how much distance between a floor on which the worker works and a ceiling with a clean air blowing apparatus is increased. However, in the local air cleaning apparatus 1, a horizontal flow is used. Thus, an increase of a region in the guide 3 can lead to an increase of a work region (floor area) for the worker himself or herself entering the clean region to perform work.

Additionally, in the open region of the present embodiment, there are no doors that allow a worker, a component, and a manufacturing machine to pass through, necessary in a typical clean room. Thus, cleanliness reduction in the clean air region caused by opening of the doors does not occur and going in-and-out of a worker and carrying-in and -out of a component or the like can be always done through the open region. In a typical clean room, when the inside of the clean room is contaminated, contaminated air in the clean room is diluted with a clean air supplied to the clean room and then exhausted to gradually clean the inside of the clean room. Accordingly, it takes a couple of hours to clean the inside of a clean room when contaminated. However, in the present invention, even if the inside of the guide 3 and the inside of the open region are contaminated, a cleaned uniform air flow blown out from the air flow opening face flows in such a manner as to extrude the contaminated air from the inside of the guide to the outside thereof, so that cleaning can be performed in an extremely short time.

Additionally, in a typical clean room, the clean air supplied to the clean room is discharged from an exhaust outlet provided in the clean room or a small gap formed between a wall face and the floor of the clean room. This is because a typical clean room makes the gap as small as possible to allow the inside of the clean room to be maintained under positive pressure so as to prevent contaminated air from entering from outside. However, unlike the clean room that discharges clean air from the small gap, the present invention can form an open region as large as possible and can clean also the formed space. Accordingly, the open region can be used as a door as mentioned above or the like, as a cleaned region.

As described above, according to the local air cleaning apparatus 1 of the present embodiment, the push hood 2 provided with the guide 3 is arranged so as to be opposed to the air collision face W, whereby the inside of the guide 3 and the open region between the opening face 31 and the air collision face W can have higher cleanliness than regions outside the local air cleaning apparatus 1. In this manner, the present invention can provide the local air cleaning apparatus 1 having a simple structure.

The present invention is, however, not limited to the above embodiment and various modifications and applications can be made. Hereinafter, a description will be given of other embodiments applicable to the present invention.

Figure 8:
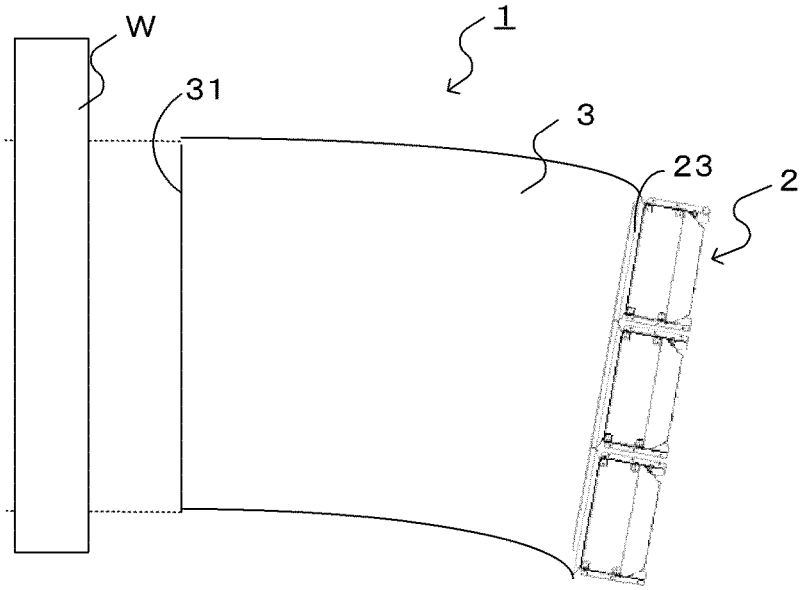
FIG. 8 is a view depicting a local air cleaning apparatus according to another embodiment of the invention.

In the above embodiment, the present invention has been described by exemplifying the case in which the shape of the guide 3 provided on the push hood 2 is straightly extended from the air flow opening face 23 of the push hood toward the opening face 31 of the guide. However, for example, as depicted in FIG. 8, the shape of the guide 3 may be curved in a range that maintains the state of a uniform air flow. Even in this case, the inside of the guide 3 and the open region between the opening face 31 and the air collision face W can have higher cleanliness than regions outside the local air cleaning apparatus 1, and a local air cleaning apparatus 1 having a simple structure can be provided.

Figure 9:
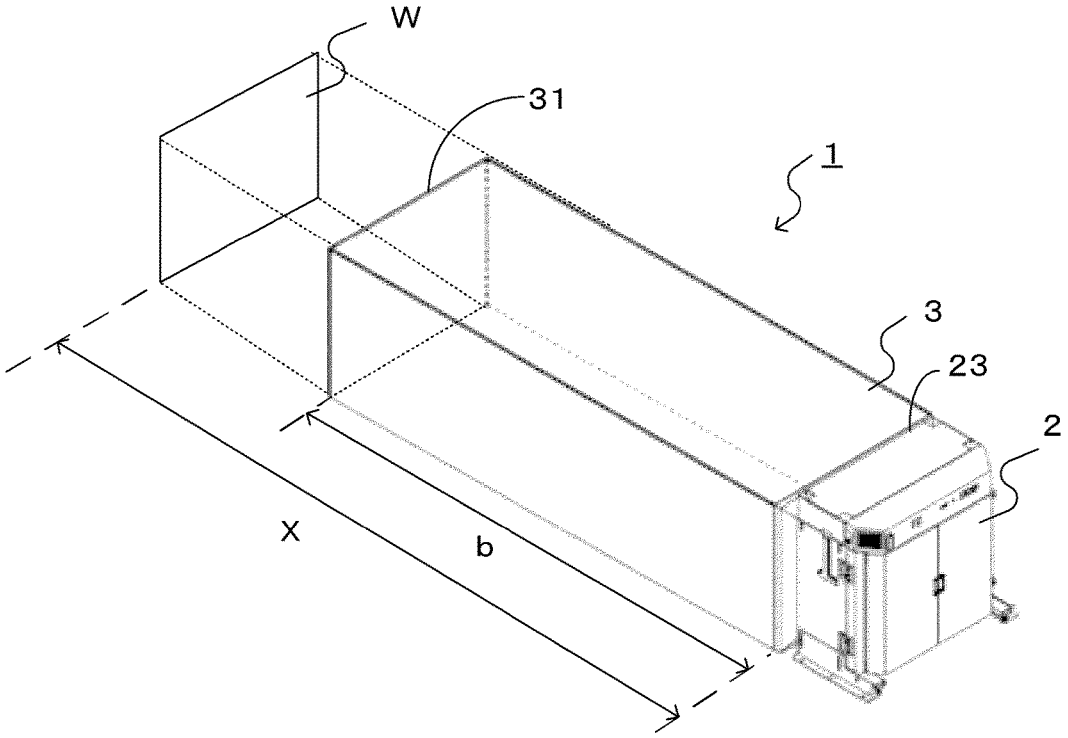
FIG. 9 is a view depicting a local air cleaning apparatus according to another embodiment of the invention.

In the above embodiment, the present invention has been described by exemplifying the case in which the push hood 2 includes, respectively, the nine (longitudinal three pieces× transversal three pieces) push hoods 2*a* connected together by a connector. However, the number of the push hoods 2*a* forming the push hood 2 may be 10 or more, or 8 or less. For example, the push hood 2 may include, respectively, four (longitudinal two pieces×transversal two pieces) push hoods 2*a* connected together by a connector. When connecting the push hoods 2*a* as in these examples, the air flow opening faces of the push hoods 2*a* are oriented in the same direction and short sides and long sides, respectively, of the mutual push hoods 2*a* are arranged adjacent to each other. In this case, preferably, the mutual push hoods 2*a* are connected together in such a manner that side faces, upper and lower faces, or both of the side faces and the upper and lower faces of the adjacent push hoods are in an airtight state, or the mutual push hoods 2*a* are connected together in an airtight state via a seal material such as a packing interposed between the side faces, the upper and lower faces, or both thereof of the adjacent push hoods 2*a*. In addition, as depicted in FIG. 9, the push hood 2 may comprise a single push hood 2*a*. Even in these cases, the inside of the guide 3 and the open region between the opening face 31 and the air collision face W can have higher cleanliness than regions outside the local air cleaning apparatus 1. Therefore, the local air cleaning apparatus 1 having a simpler structure can be provided. Additionally, in the local air cleaning apparatus 1, without using a floor as one face of the guide 3, the shape of the guide 3 may be made square.

Figure 10:
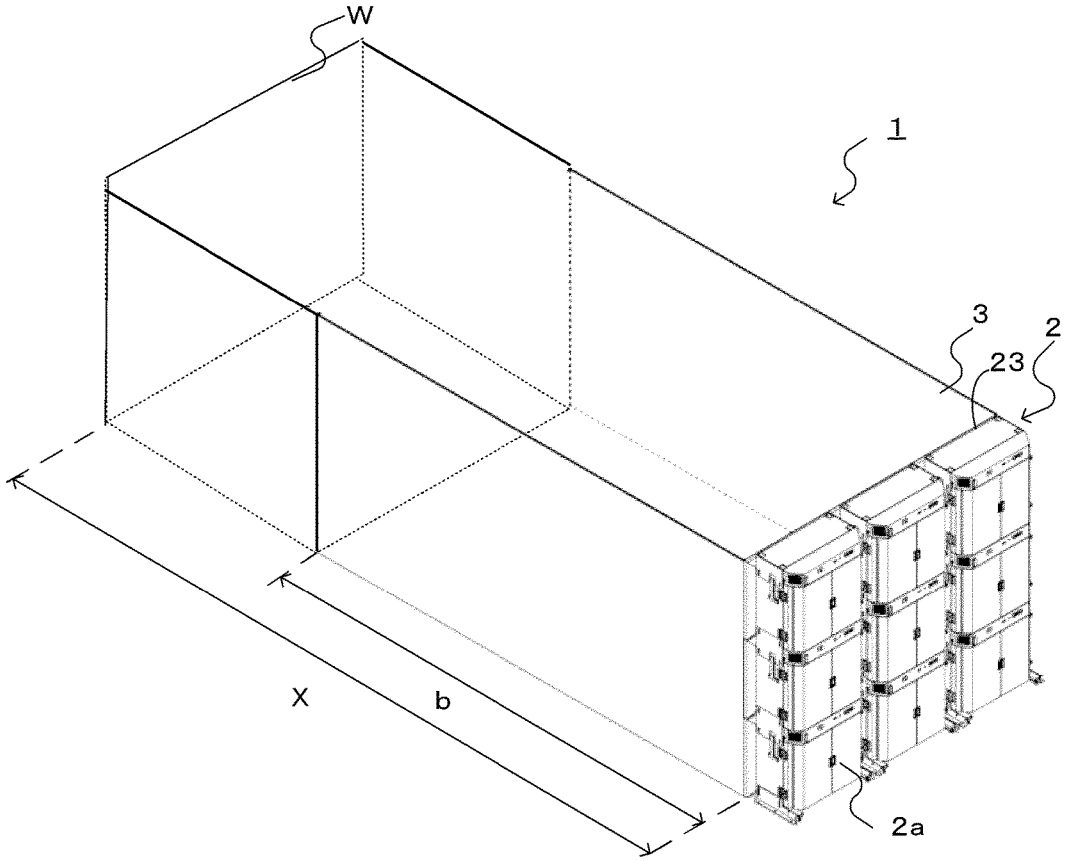
FIG. 10 is a view depicting a local air cleaning apparatus according to another embodiment of the invention.

The above embodiment has described the present invention by exemplifying the case in which, in the open region between the opening face 31 and the air collision face W, the upper face and both side faces are open. However, for example, as depicted in FIG. 10, the end portion of an upper face of the guide 3 may be connected to the air collision face W to form a region in which only side faces are open. Even in this case, the region between the air flow opening face 23 and the air collision face W can have higher cleanliness than regions outside the local air cleaning apparatus 1, and a local air cleaning apparatus 1 having a simple structure can be provided.

Figure 11:
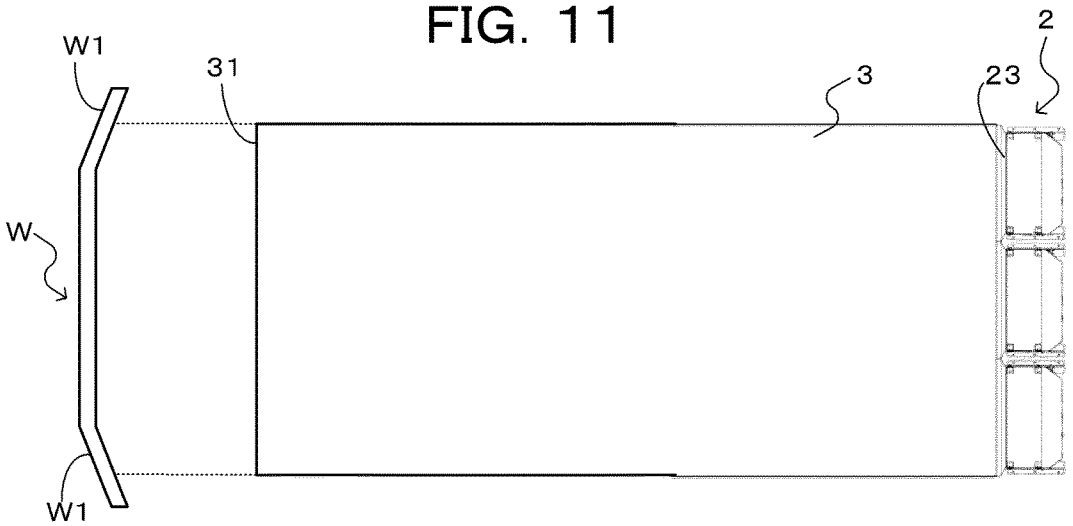
FIG. 11 is a view depicting a local air cleaning apparatus according to another embodiment of the invention.

While the above embodiment has described the present invention by exemplifying the case in which the air collision face W is flat like a wall or a partition screen, the air collision face W is not limited thereto. For example, preferably, the air collision face W has a bent portion W1 bent toward the side having the guide 3 (the push hood 2) at end portions of the air collision face W, which are near positions opposing the end portions of the opening face 31 of the guide 3, for example, at side portions of the air collision face W, as depicted in FIG. 11. Alternatively, the air collision face W may have a bent portion W1 where all of the upper portion, the lower portion, and the side portions thereof are bent toward the side having the guide 3. In addition, the bent portion W1 may have a rounded corner (have roundness on the corner) so as to have a gently curved surface. Forming the bent portion W1 in the air collision face W as above facilitates prevention of the inflow of air from the outside of the open region formed between the guide 3 and the air collision face W (outside the local air cleaning apparatus 1). Accordingly, the region between the air flow opening face 23 and the air collision face W (the inside of the guide 3 and the open region between the opening face 31 and the air collision face W) can have higher cleanliness than regions outside the local air cleaning apparatus 1, and there can be provided a local air cleaning apparatus 1 having a simple structure. Furthermore, the distance between the opening face 31 and the air collision face W and the shortest distance between the end portion of the opening face 31 and the bent portion W1 can be increased, so that a larger clean air space can be formed.

In addition, the push hood 2 may have a structure with casters on the bottom thereof. In this case, the push hood 2 can be easily moved. Additionally, the guide 3 may be a unit of a partition with casters, which has a shape flexibly connectable to the push hood 2, where the unit may be covered with a vinyl sheet. In this case, construction work can be easy and movement of the unit can also be easy. Furthermore, the guide 3 may be formed like a vinyl house extensible in a stream direction of an air flow in a shape of bellows. In this case, the length of the guide 3 can be easily changed, the guide 3 can be easily bent, and the position of the guide 3, namely, a position for obtaining a clean space can be easily changed.

For example, when forming a clean zone in a corner of a room, a side wall face and/or the floor may be substituted for a part of the guides 3.

In addition, when a part of a conveyor-like line is arranged in a clean space, the part of the line intended to be cleaned may be entirely covered to be enclosed as in a tunnel; then, a push hood 2 may be attached so as to be connected to one end of the enclosed part of the line, whereas the other end thereof may be kept in an open state (opening face 31) to arrange the air collision face W at a position opposing the open end. In such an example, when the line is arranged along a wall, the wall can be substituted for a part of the guide 3.

EXAMPLES

Hereinafter, the present invention will be described in more detail with reference to specific Examples of the invention

Example 1

Figures 12, 13:
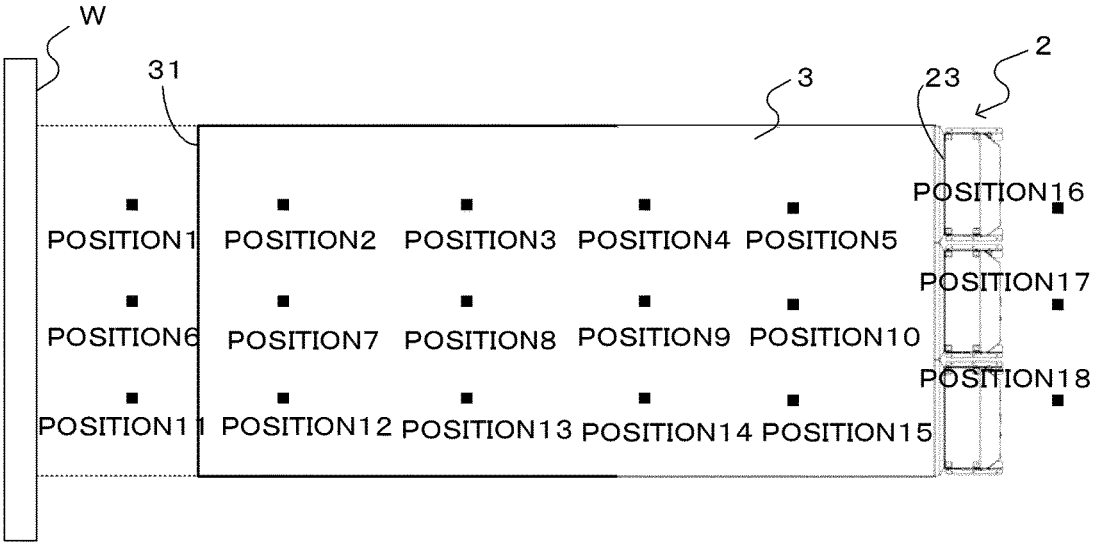
FIG. 12 is a view depicting measurement positions of Example 1.
FIG. 13 is a view depicting conditions for Examples 2 to 10.

Using the local air cleaning apparatus 1 depicted in FIG. 1, cleanliness was measured at measurement positions 1 to 15 (the inside of the guide 3 and the open region between the opening face 31 and the air collision face W) indicated in FIG. 12. FIG. 12 is a top view of the local air cleaning apparatus 1. The push hood 2 is formed by connecting nine push hoods 2*a* (longitudinal three pieces×transversal three pieces) each having a width of 1050 mm and a height of 850 mm in such a manner that air flow opening faces of the push hoods 2*a* are oriented in the same direction and short sides and long sides, respectively, of the push hoods 2*a* are respectively arranged adjacent to each other. The opening face 31 has dimensions of a width of 3150 mm and a height of 2550 mm. The measurement height for the measurement positions 1 to 15 was at a position of ½ of the height of the push hood 2. Cleanliness was measured using LASAIR-II manufactured by PMS Inc., to measure the number of dust particles (pieces/CF) having a particle size of 0.3 μm. Regarding cleanliness, cases with 300 pieces/CF or less were evaluated to be high in cleanliness. The length b of the guide 3 was 10 m, the distance X between the air flow opening face 23 of the push hood 2 and the air collision face W was 12 m, and the flow rate of the cleaned uniform air flow was 0.5 m/s. In addition, for reference, cleanliness was also similarly measured at measurement positions 16 to 18 outside the local air cleaning apparatus 1. Table 1 indicates the results.

Example 1

TABLE 1

| Position | Number of dust particles (pieces/CF) |
|---|---|
| 1 | 0 |
| 2 | 0 |

TABLE 1-continued

| Position | Number of dust particles (pieces/CF) |
|---|---|
| 3 | 0 |
| 4 | 0 |
| 5 | 0 |
| 6 | 0 |
| 7 | 0 |
| 8 | 2 |
| 9 | 1 |
| 10 | 0 |
| 11 | 1 |
| 12 | 1 |
| 13 | 2 |
| 14 | 0 |
| 15 | 0 |
| 16 | 1080000 |
| 17 | 1010000 |
| 18 | 1120000 |

As indicated in Table 1, it was able to be confirmed that arranging the push hood 2 provided with the guide 3 in such a manner as to oppose the air collision face W allowed the inside of the guide 3 and the open region between the opening face 31 and the air collision face W to have higher cleanliness than the regions outside the local air cleaning apparatus 1. In this case, it was able to be confirmed that the power consumption was 3600 W and the noise level was 75 dB(A) in the center between the air flow opening face 23 and the air collision face W, thereby enabling the provision of a local air cleaning apparatus 1 having a simple structure.

Examples 2 to 10

Figure 14:
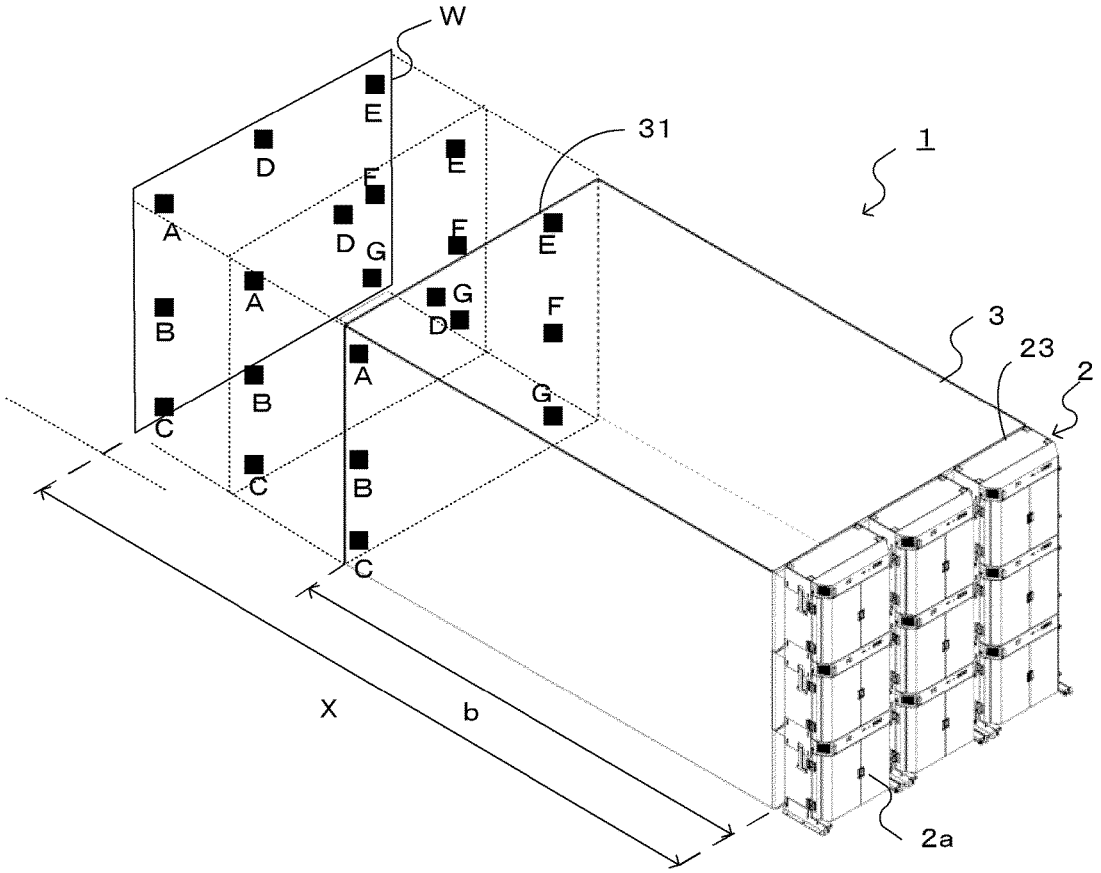
FIG. 14 is a view depicting measurement positions of Examples 2 to 10.

Using the local air cleaning apparatus 1 depicted in FIG. 1, cleanliness was measured for cases of changing the flow rate of a cleaned uniform air flow, the length b of the guide 3, and the distance X between the air flow opening face 23 of the push hood 2 and the air collision face W, as depicted in FIG. 13. In Example 1, the inside of the guide 3 was confirmed to have been cleaned. Thus, in Examples 2 to 10, cleanliness was measured at seven points as respective measurement points A to G in the opening face 31, at a position of 15 cm apart from the air collision face W toward the side having the opening face 31, and in the center between the opening face 31 and the air collision face W, respectively, as depicted in FIG. 14. The results are given in Tables 2 to 10. The positions of measurement points A, D, and E were at the positions of 15 cm downward from the upper edge of the downstream end portion of the guide 3 or the like and 15 cm inward of an air flow from the side edges of the downstream end portion of the guide. The positions of measurement points B and F were at an intermediate height between the upper edge and the lower edge of the downstream end portion of the guide 3 or the like and at the positions of 15 cm inward of the air flow from the side edges of the downstream end portion of the guide. The positions of measurement points C and G were at the positions of 15 cm upward in the guide from the lower edge of the downstream end portion of the guide 3 or the like and 15 cm inward of air flow from the side edges of the downstream end portion of the guide. Additionally, the measurement points A to G on the side having the air collision face W were at the positions of 15 cm upstream of the air flow from the air collision face W.

Example 2

TABLE 2

| Measurement point | Number of dust particles (pieces/CF) | | |
|---|---|---|---|
| | Air collision face W | Center | Opening face 31 |
| A | 0 | 0 | 1 |
| B | 2 | 2 | 11 |
| C | 1 | 0 | 0 |
| D | 0 | 3 | 4 |
| E | 0 | 4 | 4 |
| F | 1 | 2 | 2 |
| G | 5 | 7 | 137 |

Example 3

TABLE 3

| Measurement point | Number of dust particles (pieces/CF) | | |
|---|---|---|---|
| | Air collision face W | Center | Opening face 31 |
| A | 0 | 0 | 1 |
| B | 8 | 1 | 1 |
| C | 8 | 18 | 16 |
| D | 1 | 0 | 0 |
| E | 0 | 1 | 3 |
| F | 1 | 0 | 0 |
| G | 71 | 11 | 45 |

Example 4

TABLE 4

| Measurement point | Number of dust particles (pieces/CF) | | |
|---|---|---|---|
| | Air collision face W | Center | Opening face 31 |
| A | 1 | 0 | 1 |
| B | 3 | 83 | 9 |
| C | 8 | 176 | 85 |
| D | 0 | 0 | 0 |
| E | 0 | 1 | 0 |
| F | 4 | 0 | 0 |
| G | 11 | 51 | 7 |

Example 5

TABLE 5

| Measurement point | Number of dust particles (pieces/CF) | | |
|---|---|---|---|
| | Air collision face W | Center | Opening face 31 |
| A | 0 | 1 | 34 |
| B | 4 | 15 | 1 |
| C | 0 | 0 | 2 |
| D | 0 | 0 | 1 |
| E | 1 | 0 | 1 |
| F | 1 | 1 | 3 |
| G | 1 | 0 | 1 |

Example 6

TABLE 6

| Measurement point | Number of dust particles (pieces/CF) Air collision face W | Center | Opening face 31 |
|---|---|---|---|
| A | 0 | 0 | 0 |
| B | 2 | 0 | 2 |
| C | 1 | 1 | 139 |
| D | 0 | 1 | 1 |
| E | 1 | 0 | 0 |
| F | 1 | 1 | 2 |
| G | 1 | 6 | 67 |

Example 7

TABLE 7

| Measurement point | Number of dust particles (pieces/CF) Air collision face W | Center | Opening face 31 |
|---|---|---|---|
| A | 1 | 0 | 0 |
| B | 0 | 5 | 0 |
| C | 1 | 3 | 1 |
| D | 0 | 4 | 0 |
| E | 0 | 2 | 1 |
| F | 0 | 4 | 0 |
| G | 1 | 7 | 5 |

Example 8

TABLE 8

| Measurement point | Number of dust particles (pieces/CF) Air collision face W | Center | Opening face 31 |
|---|---|---|---|
| A | 0 | 42 | 4 |
| B | 12 | 20 | 20 |
| C | 237 | 0 | 6 |
| D | 0 | 12 | 7 |
| E | 0 | 45 | 37 |
| F | 1 | 78 | 33 |
| G | 142 | 20 | 121 |

Example 9

TABLE 9

| Measurement point | Number of dust particles (pieces/CF) Air collision face W | Center | Opening face 31 |
|---|---|---|---|
| A | 0 | 3 | 2 |
| B | 2 | 4 | 2 |
| C | 0 | 2 | 29 |
| D | 0 | 5 | 0 |
| E | 0 | 4 | 0 |
| F | 0 | 0 | 1 |
| G | 0 | 5 | 136 |

Example 10

TABLE 10

| Measurement point | Number of dust particles (pieces/CF) Air collision face W | Center | Opening face 31 |
|---|---|---|---|
| A | 0 | 0 | 0 |
| B | 2 | 21 | 5 |
| C | 19 | 68 | 64 |
| D | 0 | 0 | 0 |
| E | 0 | 77 | 0 |
| F | 0 | 0 | 18 |
| G | 2 | 4 | 122 |

As indicated in Tables 2 to 10, it was able to be confirmed that even when changing the flow rate of the cleaned uniform air flow, the length b of the guide 3, and the distance X between the air flow opening face 23 of the push hood 2 and the air collision face W, the inside of the guide 3 and the open region between the opening face 31 and the air collision face W were able to have higher cleanliness than the regions outside the local air cleaning apparatus 1. In addition, in this case, it was able to be confirmed that the power consumption was 1062 to 3600 W and the noise level was 59 to 75 dB(A) in the center between the air flow opening face 23 and the air collision face W.

Examples 11 to 19 and Reference Examples 1 to 9

Using the local air cleaning apparatus 1 depicted in FIG. 1 (nine push hoods 2*a*: longitudinal three pieces×transversal three pieces, each having a width of 1050 mm and a height of 850 mm), cleanliness was measured for cases in which the length b of the guide 3 was set to 12 m and the flow rate of a cleaned uniform air flow and the distance (X-b) between the opening face 31 of the guide 3 and the air collision face W were changed, as indicated in FIG. 15, (Examples 11 to 13 and Reference Examples 1 to 3). In addition, using the local air cleaning apparatus 1 depicted in FIG. 9 (a single push hood 2*a* having a width of 1050 mm and a height of 850 mm), cleanliness was similarly measured (Examples 14 to 16 and Reference Examples 4 to 6). Furthermore, using a local air cleaning apparatus 1 (four push hoods 2*a*: longitudinal two pieces×transversal two pieces, each having a width of 1050 mm and a height of 850 mm), cleanliness was similarly measured (Examples 17 to 19 and Reference Examples 7 to 9). The measurement of cleanliness was performed by measuring the number of dust particles (pieces/CF) having a particle size of 0.3 μm using LASAIR-II manufactured by PMS Inc., and cases with 300 pieces/CF or less were evaluated to be high in cleanliness (Judgment: O).

As indicated in FIG. 15, it was able to be confirmed that increasing the flow rate of the cleaned uniform air flow and increasing the number of the push hoods 2*a* to increase the width (short-side length) of the opening face 31 increased the distance between the opening face 31 and the air collision face W that can be cleaned. Specifically, it was able to be confirmed that when the number of the push hoods 2*a* was nine (the width of the opening face 31: 2650 mm), the inside of the guide 3 and the open region between the opening face 31 and the air collision face W were able to have a high cleanliness of 300 pieces/CF or less by setting the distance (X-b) between the opening face 31 of the guide 3 and the air collision face W to be not more than a distance of 3 to 4 times the flow rate (a distance over which a uniform air flow blown out from the opening face 31 collides with the air collision face W within 3 to 4 seconds). In addition, the inside of the guide 3 and the open region between the opening face 31 and the air collision face W were confirmed to be able to have a high cleanliness of 300 pieces/CF or less, when the number of the push hoods 2*a* was four (the width of the opening face 31: 1700 mm), by setting the distance (X-b) to be not more than a distance of 2.4 to 3 times the flow rate (a distance over which the uniform air flow blown out from the opening face 31 collides with the air collision face W within 2.4 to 3 seconds), and when the number of the push hoods 2*a* was one (the width of the opening face 31: 850 mm), by setting the distance (X-b) to be not more than a distance of 1.6 to 2 times the flow rate (a distance over which the uniform air flow blown out from the opening face 31 collides with the air collision face W within 1.6 to 2 seconds).

In the present Examples and Reference Examples, cases of 300 pieces/CF or less were evaluated to be high in cleanliness. However, for example, even a case of 1000 pieces/CF or less can also be evaluated to be sufficiently high in cleanliness. In this case, when the width of the opening face is 2 m or more and less than 10 m, the inside of the guide 3 and the open region between the opening face 31 and the air collision face W can have high cleanliness by setting the distance (X-b) to be not more than a distance of 4 times the flow rate (a distance over which a uniform air flow blown out from the opening face 31 collides with the air collision face W within 4 seconds). In addition, the inside of the guide 3 and the open region between the opening face 31 and the air collision face W can have high cleanliness, when the width of the opening face is set to 1 m or more and less than 2 m, by setting the distance (X-b) to be not more than a distance of 3 times the flow rate (a distance over which the uniform air flow blown out from the opening face 31 collides with the air collision face W within 3 seconds), and when the width of the opening face is set to 0.2 m or more and less than 1 m, by setting the distance (X-b) to be not more than a distance of 2 times the flow rate (a distance over which the uniform air flow blown out from the opening face 31 collides with the air collision face W within 2 seconds).

Examples 20 and 21 and Reference Examples 10 and 11

Figures 16, 17:
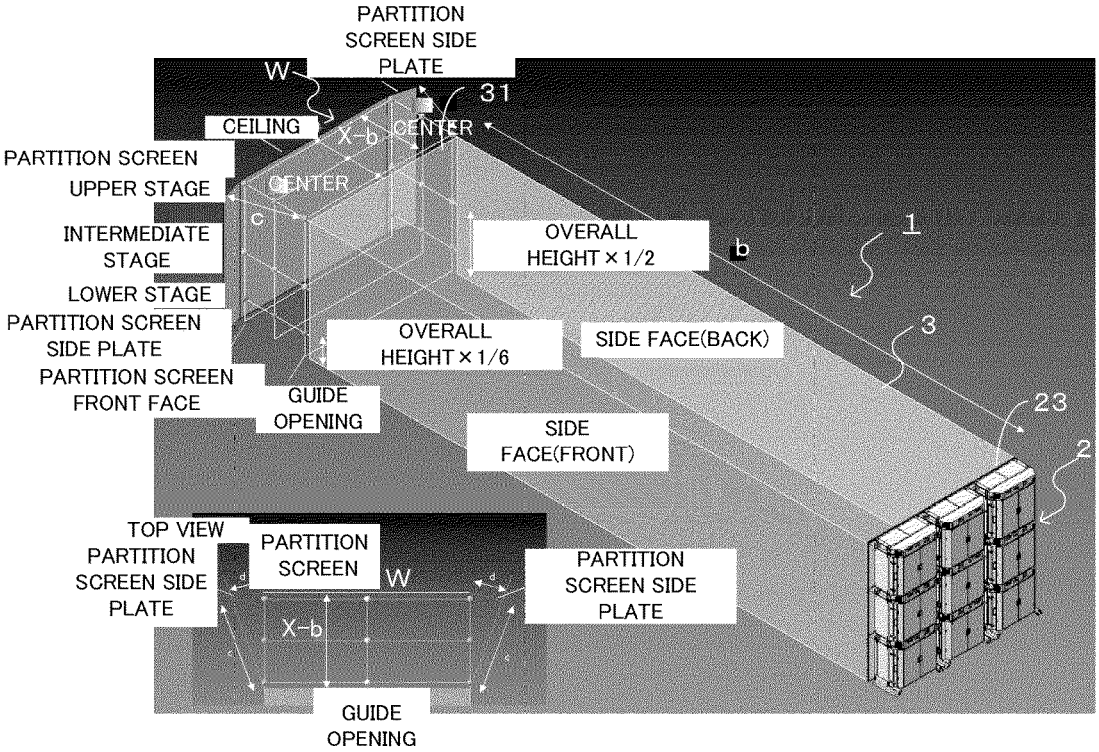
FIG. 16 is a view depicting a local air cleaning apparatus and measurement positions for Examples 20 and 21 and Reference Examples 10 and 11.
FIG. 17 is a view depicting a local air cleaning apparatus and conditions for Examples 20 and 21 and Reference Examples 10 and 11.

As depicted in FIG. 16, using a local air cleaning apparatus 1 (nine push hoods 2*a* consisting of longitudinal three pieces×transversal three pieces, each having a width of 1050 mm and a height of 850 mm) having a bent portion W1 bent toward the side having the guide 3 (the push hood 2) at side portions of the air collision face W, cleanliness was measured, as depicted in FIG. 17, for cases in which the length b of the guide 3 was 12 m and the flow rate of a cleaned uniform air flow was 0.5 m/s (Example 20 and Reference Example 10) and 0.2 m/s (Example 21 and Reference Example 11) and for cases in which the distance (X-b) between the opening face 31 of the guide 3 and the air collision face W was changed. The cleanliness was obtained by measuring the number of dust particles (pieces/CF) having a particle size of 0.3 μm using LASAIR-II manufactured by PMS Inc. In addition, as in Examples 2 to 10, the cleanliness was measured at seven points as respective measurement points A to Gin the opening face 31, at a position of 15 cm apart from the air collision face W toward the side having the opening face 31, and in the center between the opening face 31 and the air collision face W, respectively, in FIG. 14. The results are given in Tables 11 to 14.

Example 20

TABLE 11

| Measurement point | Number of dust particles (pieces/CF) | | |
|---|---|---|---|
| | Air collision face W | Center | Opening face 31 |
| A | 0 | 0 | 33 |
| B | 24 | 3 | 0 |
| C | 2 | 5 | 150 |
| D | 2 | 0 | 0 |
| E | 0 | 1 | 2 |
| F | 1 | 5 | 24 |
| G | 67 | 278 | 214 |

Reference Example 10

TABLE 12

| Measurement point | Number of dust particles (pieces/CF) | | |
|---|---|---|---|
| | Air collision face W | Center | Opening face 31 |
| A | 0 | 0 | 54 |
| B | 35 | 28 | 15 |
| C | 87 | 62 | 452 |
| D | 0 | 0 | 15 |
| E | 12 | 58 | 15 |
| F | 20 | 38 | 301 |
| G | 362 | 1230 | 1026 |

Example 21

TABLE 13

| Measurement point | Number of dust particles (pieces/CF) | | |
|---|---|---|---|
| | Air collision face W | Center | Opening face 31 |
| A | 13 | 130 | 229 |
| B | 208 | 249 | 29 |
| C | 141 | 5 | 175 |
| D | 4 | 0 | 0 |
| E | 37 | 0 | 0 |
| F | 182 | 149 | 0 |
| G | 59 | 38 | 130 |

Reference Example 11

TABLE 14

| Measurement point | Number of dust particles (pieces/CF) | | |
|---|---|---|---|
| | Air collision face W | Center | Opening face 31 |
| A | 56 | 238 | 352 |
| B | 198 | 683 | 453 |
| C | 257 | 875 | 1520 |
| D | 0 | 0 | 57 |

TABLE 14-continued

| Measurement point | Number of dust particles (pieces/CF) | | |
|---|---|---|---|
| | Air collision face W | Center | Opening face 31 |
| E | 102 | 8 | 0 |
| F | 386 | 305 | 2 |
| G | 108 | 254 | 347 |

As indicated in Example 11, Reference Example 1, Example 20, and Reference Example 10, it was able to be confirmed that by having the bent portion W1 bent toward the side having the guide 3 (push hood 2) at the side portions of the air collision face W, the distance between the opening face 31 and the air collision face W that can be cleaned increased to from 1.5 to 2 m, as well as the shortest distance c between the end portion of the opening face 31 and the bent portion W1 increased to 1.93 m. In addition, as depicted in Example 13, Reference Example 3, Example 21, and Reference Example 11, it was able to be confirmed that, by having the bent portion W1 bent toward the side thereof having the guide 3 at the side portions of the air collision face W, the distance between the opening face 31 and the air collision face W that can be cleaned increased to from 0.8 to 1.2 m, as well as the shortest distance c between the end portion of the opening face 31 and the bent portion W1 increased to 1.16 m. Thus, it was confirmed that, due to the arrangement of the bent portion W1 bent toward the side having the guide 3 at the side portions of the air collision face W, there can be provided a local air cleaning apparatus 1 having a simple structure and a larger clean air space can be formed.

Accordingly, the local air cleaning apparatus 1 using the air collision face W having the bent portion W1 (the nine push hoods 2*a* (the width of the opening face 31: 2650 mm)) was confirmed to be able to have a high cleanliness of 300 pieces/CF or less by setting the distance (X-b) between the opening face 31 of the guide 3 and the air collision face W to be not more than a distance of 6 times the flow rate (a distance over which a uniform air flow blown out from the opening face 31 collides with the air collision face W within 6 seconds).

In addition, it was confirmed that, with the local air cleaning apparatus 1 using the air collision face W having the bent portion W1, a high cleanliness of 300 pieces/CF or less can be obtained, when the number of the push hoods 2*a* is four (the width of the opening face 31: 1700 mm), by setting the distance (X-b) to be not more than a distance of 5 times the flow rate (a distance over which the uniform air flow blown out from the opening face 31 collides with the air collision face W within 5 seconds), and when the number of the push hoods 2*a* is one (the width of the opening face 31: 850 mm), by setting the distance (X-b) to be not more than a distance of 3 times the flow rate (a distance over which the uniform air flow blown out from the opening face 31 collides with the air collision face W within 3 seconds).

The present application is based on Japanese Patent Application No. 2011-166316 filed on Jul. 29, 2011, Japanese Patent Application No. 2011-196726 filed on Sep. 9, 2011, and Japanese Patent Application No. 2011-222785 filed on Oct. 7, 2011, the entire specifications, claims, and drawings of which are incorporated herein by reference.

INDUSTRIAL APPLICABILITY

The present invention is useful for air cleaning in a local work space.

REFERENCE SIGNS LIST

1 Local air cleaning apparatus
2,2*a* Push hood
3 Guide
21 Housing
22 Air flow suction face
23 Air blowout face (Air flow opening face)
24 Air blowing mechanism
25 Higher performance filter
26 Rectification mechanism
27 Pre-filter
31 Opening face
L Width of opening face
W Air collision face

The invention claimed is:

1. A local air cleaning apparatus comprising:

a push hood comprising an air flow opening face for blowing out a cleaned uniform air flow and a guide provided on a side of the push hood comprising the air flow opening face, the guide extending from the side thereof comprising the air flow opening face toward a downstream side of the uniform air flow to form an opening face at an downstream-side end portion of the guide, wherein the push hood is arranged such that the cleaned uniform air flow blown out from the air flow opening face passes through the inside of the guide and then collides with a wall on a downstream side of the opening face of the guide;

the opening face of the guide is spaced apart from and opposed to the wall to form an open region between the opening face of the guide and the wall;

the cleaned uniform air flow blown out from the air flow opening face collides with the wall to flow out of the open region so as to cause the inside of the guide and the inside of the open region to be a work region having higher cleanliness, for an operator, than other regions; and the guide is configured to increase the work region while maintaining the higher cleanliness within the work region by enabling a distance between the air flow opening face and the wall with having the guide to be greater than a distance therebetween without having the guide on the side of the air flow opening face.

2. The local air cleaning apparatus according to claim 1, wherein the opening face of the guide and the air flow opening face of the push hood are of substantially the same shape.

3. The local air cleaning apparatus according to claim 1, wherein the push hood comprises a plurality of push hoods connected together.

4. The local air cleaning apparatus according to claim 1, wherein the cleaned uniform air flow blown out from the air flow opening face has a flow rate of 0.2 to 0.5 m/s.

5. The local air cleaning apparatus according to claim 1, wherein the opening face of the guide has a width of 2 m or more and less than 10 m and the distance between the opening face of the guide and the wall is a distance over which the uniform air flow blown out from the opening face collides with the wall within 4 seconds.

6. The local air cleaning apparatus according to claim 1, wherein the opening face of the guide has a width of 1 m or more and less than 2 m and the distance between the opening face of the guide and the wall is a distance over which the uniform air flow blown out from the opening face collides with the wall within 3 seconds.

7. The local air cleaning apparatus according to claim 1, wherein the opening face of the guide has a width of 0.2 m or more and less than 1 m and the distance between the opening face of the guide and the wall is a distance over which the uniform air flow blown out from the opening face collides with the wall within 2 seconds.

8. The local air cleaning apparatus according to claim 1, wherein the wall has a bent portion bent toward the guide side near positions opposing end portions of the opening face of the guide.

9. The local air cleaning apparatus according to claim 8, wherein the opening face of the guide has a width of 2 m or more and less than 10 m and the distance between the opening face of the guide and the wall is a distance over which the uniform air flow blown out from the opening face collides with the wall within 6 seconds.

10. The local air cleaning apparatus according to claim 8, wherein the opening face of the guide has a width of 1 m or more and less than 2 m and the distance between the opening face of the guide and the wall is a distance over which the uniform air flow blown out from the opening face collides with the wall within 5 seconds.

11. The local air cleaning apparatus according to claim 8, wherein the opening face of the guide has a width of 0.2 m or more and less than 1 m and the distance between the opening face of the guide and the wall is a distance over which the uniform air flow blown out from the opening face collides with the wall within 3 seconds.

12. A local air cleaning apparatus comprising:

a push hood comprising an air flow opening face for blowing out a cleaned uniform air flow and a guide provided on a side of the push hood comprising the air flow opening face, the guide extending from the side thereof comprising the air flow opening face toward a downstream side of the uniform air flow to form an opening face at an downstream-side end portion of the guide, wherein the push hood is arranged such that the cleaned uniform air flow blown out from the air flow opening face passes through the inside of the guide and then collides with a screen partition on a downstream side of the opening face of the guide;

the opening face of the guide is spaced apart from and opposed to the screen partition to form an open region between the opening face of the guide and the screen partition;

the cleaned uniform air flow blown out from the air flow opening face collides with the screen partition to flow out of the open region so as to cause the inside of the guide and the inside of the open region to be a work region having higher cleanliness, for an operator, than other regions; and the guide is configured to increase the work region while maintaining the higher cleanliness within the work region by enabling a distance between the air flow opening face and the screen partition with having the guide to be greater than a distance therebetween without having the guide on the side of the air flow opening face.

13. The local air cleaning apparatus according to claim 12, wherein the opening face of the guide and the air flow opening face of the push hood are of substantially the same shape.

14. The local air cleaning apparatus according to claim 12, wherein the push hood comprises a plurality of push hoods connected together.

15. The local air cleaning apparatus according to claim 12, wherein the cleaned uniform air flow blown out from the air flow opening face has a flow rate of 0.2 to 0.5 m/s.

16. The local air cleaning apparatus according to claim 12, wherein the opening face of the guide has a width of 2 m or more and less than 10 m and the distance between the opening face of the guide and the screen partition is a distance over which the uniform air flow blown out from the opening face collides with the screen partition within 4 seconds.

17. The local air cleaning apparatus according to claim 12, wherein the opening face of the guide has a width of 1 m or more and less than 2 m and the distance between the opening face of the guide and the screen partition is a distance over which the uniform air flow blown out from the opening face collides with the screen partition within 3 seconds.

18. The local air cleaning apparatus according to claim 12, wherein the opening face of the guide has a width of 0.2 m or more and less than 1 m and the distance between the opening face of the guide and the screen partition is a distance over which the uniform air flow blown out from the opening face collides with the screen partition within 2 seconds.

19. The local air cleaning apparatus according to claim 12, wherein the screen partition has a bent portion bent toward the guide side near positions opposing end portions of the opening face of the guide.

20. The local air cleaning apparatus according to claim 19, wherein the opening face of the guide has a width of 2 m or more and less than 10 m and the distance between the opening face of the guide and the screen partition is a distance over which the uniform air flow blown out from the opening face collides with the screen partition within 6 seconds.

21. The local air cleaning apparatus according to claim 19, wherein the opening face of the guide has a width of 1 m or more and less than 2 m and the distance between the opening face of the guide and the screen partition is a distance over which the uniform air flow blown out from the opening face collides with the screen partition within 5 seconds.

22. The local air cleaning apparatus according to claim 19, wherein the opening face of the guide has a width of 0.2 m or more and less than 1 m and the distance between the opening face of the guide and the screen partition is a distance over which the uniform air flow blown out from the opening face collides with the screen partition within 3 seconds.

* * * * *